US007131367B1

(12) United States Patent
Boerschig et al.

(10) Patent No.: US 7,131,367 B1
(45) Date of Patent: Nov. 7, 2006

(54) HYDRAULIC BOLT BUFFER FOR FIREARM

(75) Inventors: Timothy J. Boerschig, Amherst, NY (US); Brian C. Bucholtz, Lakeview, NY (US)

(73) Assignee: Enidine, Inc., Orchard Park, NY (US)

( * ) Notice: Subject to any disclaimer, the term of this patent is extended or adjusted under 35 U.S.C. 154(b) by 0 days.

(21) Appl. No.: 11/114,304

(22) Filed: Apr. 26, 2005

(51) Int. Cl.
*F41A 3/78* (2006.01)

(52) U.S. Cl. ..... 89/198; 89/1.7; 42/1.06

(58) Field of Classification Search ..... 89/1.7, 89/198; 42/1.06, 70.101, 74
See application file for complete search history.

(56) References Cited

U.S. PATENT DOCUMENTS

| | | | | | |
|---|---|---|---|---|---|
| 2,426,563 | A | * | 8/1947 | Patchett | 89/198 |
| 2,504,958 | A | * | 4/1950 | Botts et al. | 89/198 |
| 2,831,404 | A | * | 4/1958 | Sampson et al. | 89/198 |
| 3,366,011 | A | | 1/1968 | Sturtevant | |
| 3,603,577 | A | * | 9/1971 | DeRaad | 267/151 |
| 3,977,296 | A | * | 8/1976 | Silsby et al. | 89/198 |
| 4,126,080 | A | * | 11/1978 | Reynolds | 89/199 |
| 4,150,819 | A | * | 4/1979 | Taylor | 267/136 |
| 4,335,644 | A | * | 6/1982 | Goes et al. | 89/198 |
| H000217 | H | * | 2/1987 | Jorczak | 89/43.01 |
| 4,667,566 | A | * | 5/1987 | Bosshard et al. | 89/44.01 |
| 4,833,808 | A | * | 5/1989 | Strahan | 42/1.06 |
| 4,938,116 | A | * | 7/1990 | Royster | 89/198 |
| 5,909,002 | A | * | 6/1999 | Atchisson | 89/130 |
| 6,758,126 | B1 | * | 7/2004 | Houtsma | 89/198 |
| 6,829,974 | B1 | | 12/2004 | Gwinn, Jr. | |
| 6,901,689 | B1 | * | 6/2005 | Bergstrom | 42/1.06 |
| 2004/0154465 | A1 | * | 8/2004 | Martin | 89/42.01 |

* cited by examiner

*Primary Examiner*—Michael J. Carone
*Assistant Examiner*—Benjamin P. Lee
(74) *Attorney, Agent, or Firm*—Peter J. Bilinski

(57) ABSTRACT

A hydraulic bolt buffer assembly for an automatic firearm, the firearm including a receiver having a longitudinal chamber, a bolt and carrier assembly mounted in the chamber for reciprocating movement between a recoil position and a battery position, a spring for urging the buffer into contact with the bolt and carrier assembly for movement therewith and for biasing said bolt and carrier assembly toward the battery position. The buffer assembly includes a housing having an inner cavity, as well as a piston disposed within the inner cavity of the housing that is movable between an extended position and a depressed position, the piston being in contact with the bolt and carrier assembly. The buffer further includes a spring for biasing the piston in the extended position, as well as a bearing member in fixed relation in the housing and permitting a fluid tight seal with the interior of the buffer housing. The bearing further includes a cavity for retaining an accumulator disposed in a fluid chamber and in which movement of the piston based on movement of the bolt and carrier assembly causes hydraulic fluid contained in a first fluid chamber of said cavity to be moved to a second fluid chamber of said cavity containing the accumulator to slow the firing rate of the firearm.

11 Claims, 4 Drawing Sheets

HYDRAULIC BOLT BUFFER FOR FIREARM

FIELD OF THE INVENTION

The invention relates in general to firearms capable of automatic or semi-automatic operation, and in particular to a buffer for reducing or slowing the cyclic rate of firing for such firearms.

BACKGROUND OF THE INVENTION

Firearms that are capable of automatic or semi-automatic operation, such as the M-16 rifle, are replete and extremely well known. Accuracy using such firearms is not successful unless the firearm is fired in short bursts due to the recoil of successive rounds causing the barrel of the firearm to climb upwardly and to the right, for the right handed shooter. The M-16 rifle, for example, fires at a cyclic rate of approximately 750 rounds per minute (RPM) wherein this rate, as combined with the impulse produced by a 5.56 mm cartridge makes it difficult for the shooter of such a firearm to consistently produce a controlled pattern of shots.

There have been numerous attempts that have been made to reduce the cyclic rate of fire of automatic and semi-automatic firearms, using a buffer assembly, wherein the recoil force is stored by the action or operating spring of the firearm and the bolt is returned from the recoil position to the battery position. For example, U.S. Pat. No. 3,977,296 describes a typical hydraulic buffer assembly used for decreasing the cyclic firing rate. According to the design of the '296 buffer assembly the bolt carrier, bolt and the buffer are each accelerated rearward from the battery position when the automatic firearm is fired. Each of the bolt, bolt carrier and the buffer are moved in unison toward the recoil position against the action or operating spring of the firearm. An elastomeric bumper provided on the end of the buffer contacts the end wall of the receiver extension. At this point, the buffer compresses and forces hydraulic fluid contained within the buffer through an orifice provided in a cylinder, thereby creating a resisting force. This resisting force decelerates the bolt as well as the bolt carrier, thus extending the recoil period. Furthermore and during counter-recoil (e.g., return of the bolt/bolt carrier assembly and buffer to the firing position), there is less rebound energy from the end of the recoil stroke such that the buffer/bolt are returned at a slower rate, which further delays the return of each of the assemblies back to the battery position. This delay thereby results in a slower firing rate of the firearm. Upon return to the battery position, the buffer also absorbs some of the kinetic energy of the bolt and the bolt carrier as they stop on the breech end of the barrel, such that these elements do not "bounce" off the breech end of the barrel.

There are a number of problems noted with regard to the above-described buffer design. First, the '296 buffer relies upon the use of dynamic seals. Dynamic seals, however, are more prone to leakage than static seals. The design of the above described '296 buffer includes a pair of dynamic seals, each of which create a potential leakage path. Hydraulic fluid loss can result in degraded performance. The internal spring of the '296 buffer continually acts upon the damping fluid, which in turn acts to hydraulically extend the piston rod. If the buffer unit leaks enough fluid, the piston will be compressed by the action spring thus reducing or eliminating the stroke in the buffer. The buffer would then merely act as a single mass only within the gun recoil system—which may only marginally reduce the firing rate and perhaps no longer reduce the condition known colloquially as "bolt bounce" from occurring. Bolt bounce has the potential for stopping the automatic firing sequence before the operator has the intention to do so.

In addition, the seals that are used in the '296 design are simple O-rings, each sealing dynamically upon an internal diameter bore, upon which can be difficult to obtain a smooth, hard, defect-free surface finish. This form of seal is prone to "weeping", and is also more prone to rolling or twisting within its groove—the latter also leading to potential leakage. The '296 buffer design further relies upon a spring—loaded accumulator to provide a force that is sufficiently high enough to exceed the preload of the action spring of the firearm and thereby maintain the piston rod in the extended position. This form of accumulator provides a positive internal pressure within the buffer at all times. This pressure further acts to force the hydraulic fluid out of the buffer at all times.

Furthermore, the above-described '296 hydraulic buffer has four (4) separate stroke lengths that require size considerations in the placement of same in the firearm and making application of this design difficult in guns having shorter stocks. A buffer, such as the above-described '296 design, further includes the elastomeric plug or bumper which holds the spring in place, which in turn loads the sliding seal separator. If this plug or bumper were to loosen even partially, the function of the buffer would degrade.

SUMMARY OF THE INVENTION

According to one aspect of the present invention, there is described a hydraulic bolt buffer assembly for an automatic firearm, said automatic firearm including a receiver having a longitudinal chamber, a bolt and carrier assembly mounted in said longitudinal chamber for reciprocating movement between a recoil position and a battery position, a spring for urging the buffer into contact with the bolt and carrier assembly for movement therewith and for biasing said bolt and carrier assembly toward the battery position, said buffer assembly comprising: a housing having an inner cavity; a piston disposed within the inner cavity of said housing and movable between an extended position and a depressed position, said piston being in contact with said bolt and carrier assembly; a spring disposed within the inner cavity of said housing, said spring biasing said piston in said extended position; and a bearing member in fixed relation in said housing cavity, said bearing including means for providing a fluid-tight seal in said inner cavity and further including a cavity for retaining a compressible foam material contained in a variable fluid chamber.

According to one version, a hydraulic fluid is contained within the inner cavity of the housing wherein the piston causes the fluid to move between a first variable volume fluid chamber and a second variable volume fluid chamber as the piston is moved therethrough, the compressible foam material being contained in the second variable fluid chamber such that hydraulic fluid is caused to compress the foam material when the firearm reaches the recoil position. As the piston is extended under the bias of the contained spring within the buffer and as the bolt and carrier assembly is moved towards the battery position, the hydraulic fluid is again moved from the second variable fluid chamber to the first variable fluid chamber, decompressing the foam material.

According to one version, an elastomeric bumper is also disposed on an opposing end of the buffer relative to the piston, the bumper being configured to engage the operating spring of the firearm. The bumper is fitted to the end of the buffer housing covering a fill plug which is used to fill the inner cavity with hydraulic fluid.

An advantage of the present invention is that the herein described buffer assembly only requires a single dynamic seal provided on the piston rod. Therefore, the number of potential leak paths is significantly reduced from previously known designs.

In addition, the herein described buffer design utilizes a U-cup type seal, sealing upon a hard plated shaft, which can be easily ground and plated in order to obtain a smooth, hard running surface for the rod seal lip. The U-cup type seal is also less prone to twisting, rolling, and weeping due to its geometry.

Another advantage of the present buffer design is the use of a closed cell-foam accumulator which provides only a positive pressure in the buffer assembly when the piston rod is compressed or when the buffer assembly becomes hot. While the piston assembly is extended and the buffer is at room temperature, the internal pressure of the buffer is at atmospheric pressure, thus there is no pressure that is attempting to force the hydraulic fluid from the buffer the majority of the time.

Advantageously, the new buffer design has an elastomeric plug or bumper which is installed in a blind cavity at the end of the buffer housing. If the bumper were to dislodge partially, the buffer will still properly function because the bumper is not influencing other portions of the damper.

Another advantage of the present buffer design is that the herein described assembly is more fail-safe in the event the buffer should wear out and leak hydraulic fluid. A buffer assembly made in accordance with the present design having no hydraulic fluid contained within the inner cavity will still stroke because the spring acts directly upon the piston rod and is thus independent of hydraulic damping. Due to this continuation of the stroke action, the buffer will still continue to function as an inertial spring-mass buffer (i.e., inertia of internal components) to help reduce cycle rate and bolt bounce.

Another advantage of the present design is the buffer can be designed to fit in firearms having shorter or collapsible stocks due to the more efficient use of space. The present design incorporates the buffer's stroke in two areas as opposed to 4 areas in previous designs.

These and other features and advantages will be readily apparent from the following Detailed Description which should be read in conjunction with the accompanying drawings.

GENERAL DESCRIPTION OF THE INVENTION

The following description relates to a specific embodiment of a hydraulic bolt buffer assembly as used within a specific automatic firearm. It will be readily apparent that there are other variations and modifications to the herein described design that will become apparent to one of sufficient skill in the field, including the use of same with other related firearms. In addition, a number of terms are used throughout the discussion in order to provide an adequate frame of reference with regard to the accompanying drawings. These terms, unless indicated otherwise, however, should not be regarded as overly limiting of the present invention.

Figure 1:
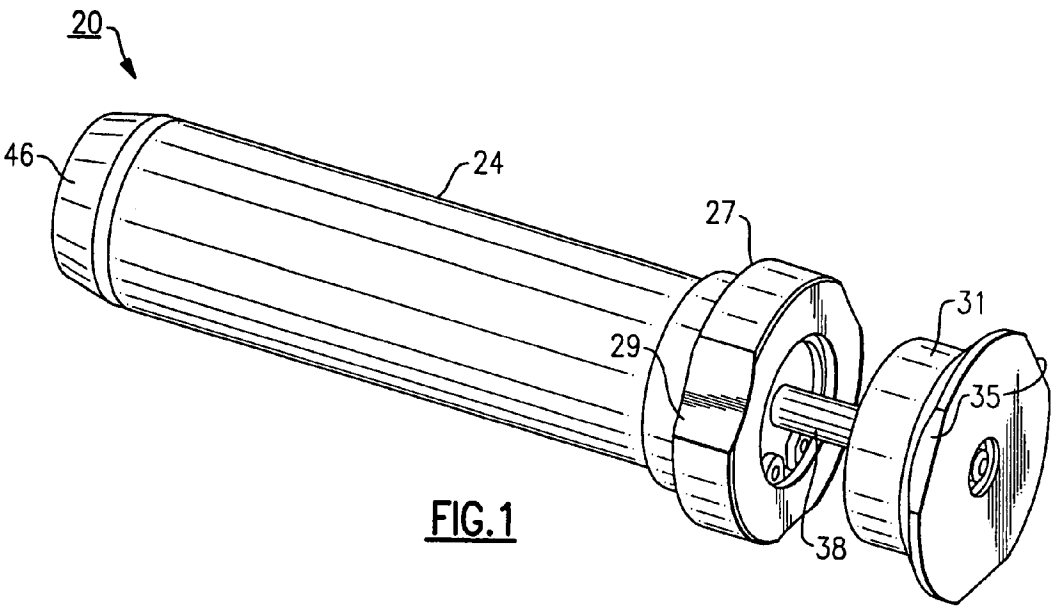
FIG. 1 is a perspective view of a hydraulic bolt buffer assembly in accordance with an embodiment of the present invention.
Figure 2:
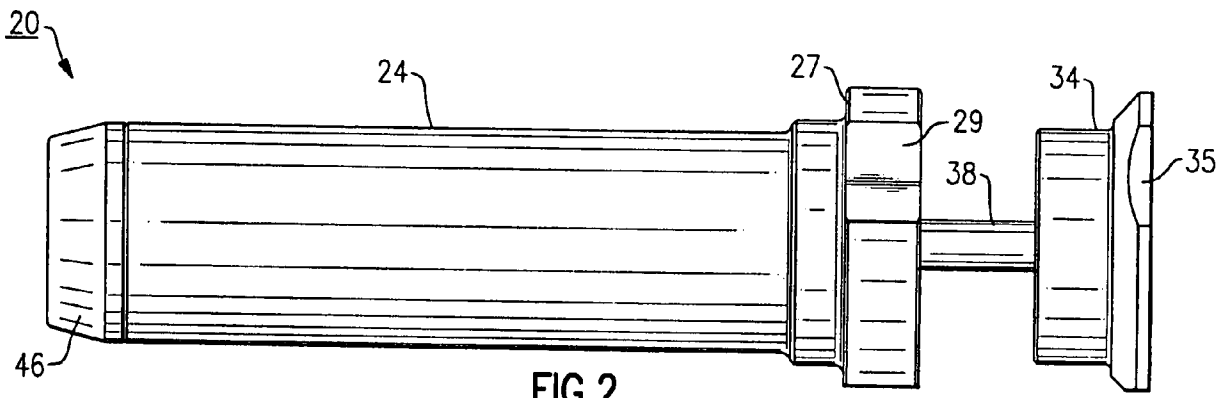
FIG. 2 is a side view of the hydraulic bolt buffer assembly of FIG. 1.
Figure 3:
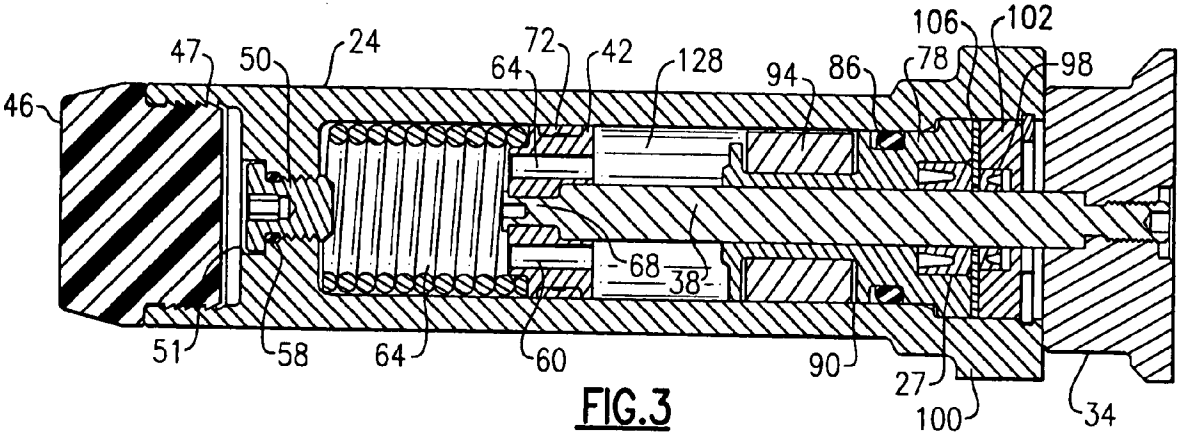
FIG. 3 is a side sectional view of the hydraulic bolt buffer assembly of FIGS. 1 and 2, taken in a recoil position thereof.
Figure 4:
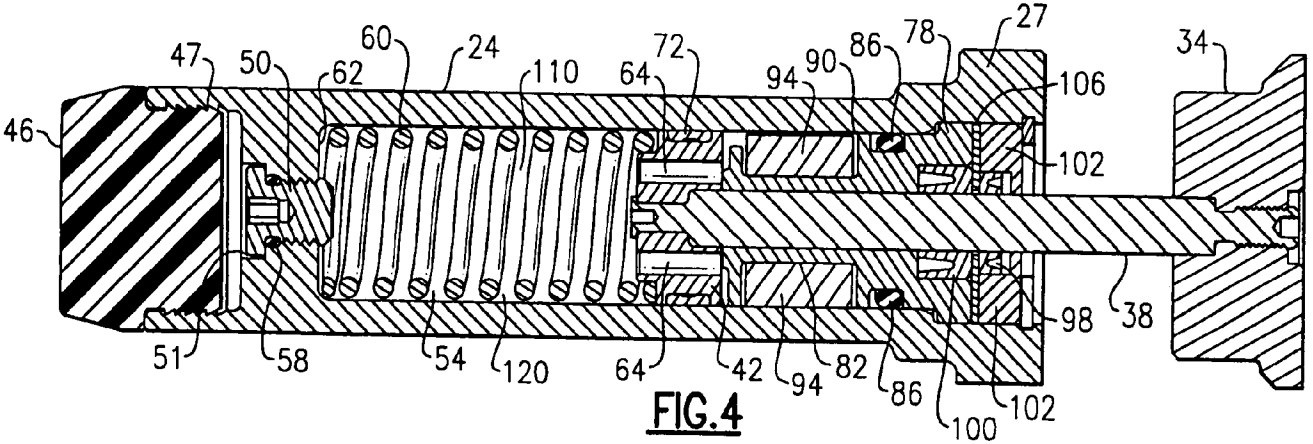
FIG. 4 is the side sectional view of the buffer assembly of FIG. 3, taken in a battery position thereof.

Referring to FIGS. 1 and 2, the hydraulic bolt buffer assembly (hereinafter referred to as the buffer assembly or the buffer and referred to throughout by reference numeral 20), includes a substantially cylindrical housing 24 that includes an exterior annular guide flange 27 adjacent to a proximal open end or cavity that is sized for retaining a number of components and into which a piston assembly 30 is attached. The piston assembly 30 includes a piston cap 34, an extending piston rod 38 and a piston head 42, FIG. 3. The annular guide flange 27 and the piston cap 34 include three (3) circumferentially spaced flats 29, 35, respectively. The opposite or distal end of the buffer housing 24 includes an elastomeric bumper 46, which as shown in FIGS. 3 and 4, is retained within an end cavity 47 of the housing 24. The piston head 42 is disposed within the confines of the buffer housing 24, while the piston cap 34 is spring loaded against the bolt carrier assembly 215, FIG. 5, of a firearm 200, FIG. 5. The function of each of the preceding components will be described in greater detail below.

Referring to FIGS. 3 and 4, and in terms of the contained components, the elastomeric bumper 46 is attached to the distal end of the housing 24 and the end cavity 47 by means of circumferential grooves formed in the housing. Other forms of connection are possible, though it is preferred that the bumper 46 be releasably attached to permit access to the interior of the housing 24. According to this embodiment, the bumper 46 is made from a urethane or rubberized material of high durometer rating or other suitable energy-absorbing material. An intermediate orifice 51 of the housing 24 extending between the end cavity 47 and an inner cavity 54 of the housing receives a fill plug 50, the fill plug including means for retaining an O-ring 58 on an annular exterior portion thereof which engages the interior surface of the orifice to provide a fluid-tight seal. The inner cavity 54 extends axially from an end wall 62 to the open opposing end of the housing 24, the housing cavity receiving a coil spring 60 that is disposed between the end wall and the distal side of the axially movable piston head 42.

Still referring to FIGS. 3 and 4, the piston head 42 includes a plurality of axial orifices 64 extending therethrough, two of which are shown, though it will be readily apparent that this number and the size/diameter can be suitably varied for purposes of the design. The piston rod 38 extends axially through a center opening 68 formed in the piston head 42 and terminates therein, the rod end being fluid sealed within the center opening. The piston head 42 further includes a radial glide seal member 72 disposed on the exterior thereof for engaging the interior wall of the housing cavity 54, permitting the piston head to be axially movable within the housing cavity 54, as described in greater detail below.

The opposite end of the piston rod 38 is similarly attached through a center opening which is formed in the piston cap 34, the piston cap as noted previously, being disposed outside of the buffer housing 24. The piston rod 38 is fixedly secured within each of the center openings of the piston cap 34 and the piston head 42.

A cylindrical bearing 78 is also situated within the buffer housing 24 proximally of the piston head 42 through which the piston rod 38 is also fitted through a center opening 82. The bearing 78 is fixedly attached within the housing 24, preventing axial movement thereof such that the piston rod is axially movable therethroiigh. An O-ring 86, provided on an exterior annular groove of the bearing 78, engages the interior wall of the housing and provides a fluid-tight seal for the interior cavity 54 of the buffer housing 24. An exterior circumferential recess 90 of the cylindrical bearing 78 located distally of the O-ring 86 retains an annular portion of closed cell foam material 94, the foam material extending radially into contact with the interior wall of the buffer housing 24.

A U-cup type rod seal 100 is provided on the interior of the cylindrical bearing 78 at the proximal end thereof, and a wiper 98 is supported within a wiper retainer 102. A retaining plate 106 is disposed distally of the wiper retainer 102, each of the plate and the retainer having a center opening permitting the piston rod 38 to extend therethrough.

Each of the ends of the piston rod 38 are also sealed with caps wherein the axial ends of the piston rods are each narrowed in diameter relative to the remainder of the rod in terms of engagement within the center openings of the piston head 42 and the piston cap 34, respectively.

Referring to FIGS. 3 and 4, a volumetric quantity of a hydraulic fluid 110 is added to the confines of the inner cavity 54 of the buffer housing 24 that is defined between the bearing 78 and the end wall 62, the fluid being added into the chamber through the intermediate orifice 51 defined by the fill plug 50 and is sealed therewith. The piston cap 34 is aligned with the bolt carrier assembly wherein the piston cap and the piston head 42 are each capable of axial movement against the bias of the contained spring 60. In addition, the entire buffer assembly 20, as loaded against the bolt carrier assembly 215, FIG. 7, is also axially movable against the bias of the action or operating spring 246 of the firearm 200.

Figure 5:
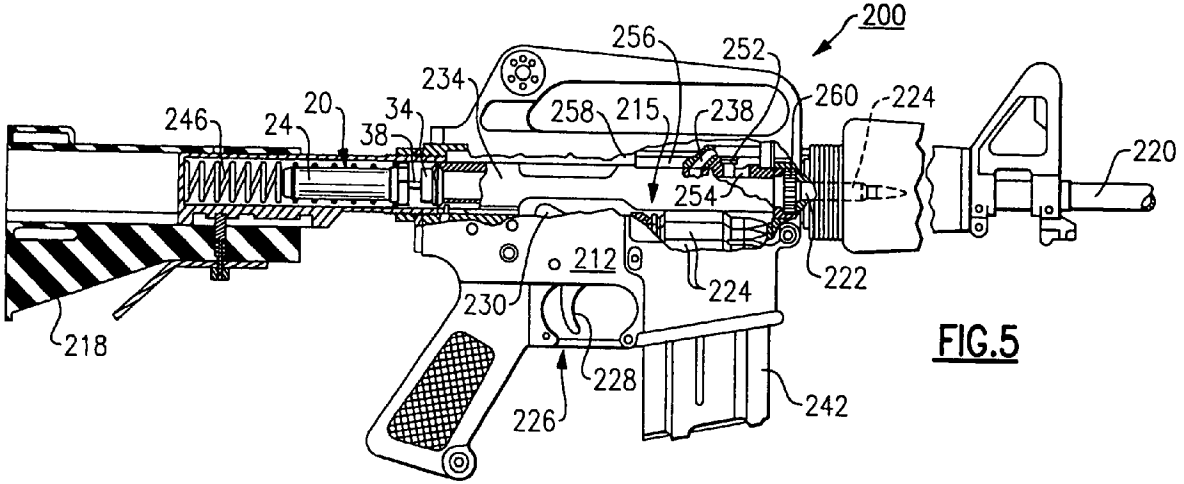
FIG. 5 is a side view of the hydraulic bolt buffer assembly of FIGS. 1–4, as used in an automatic firearm.
Figure 6:
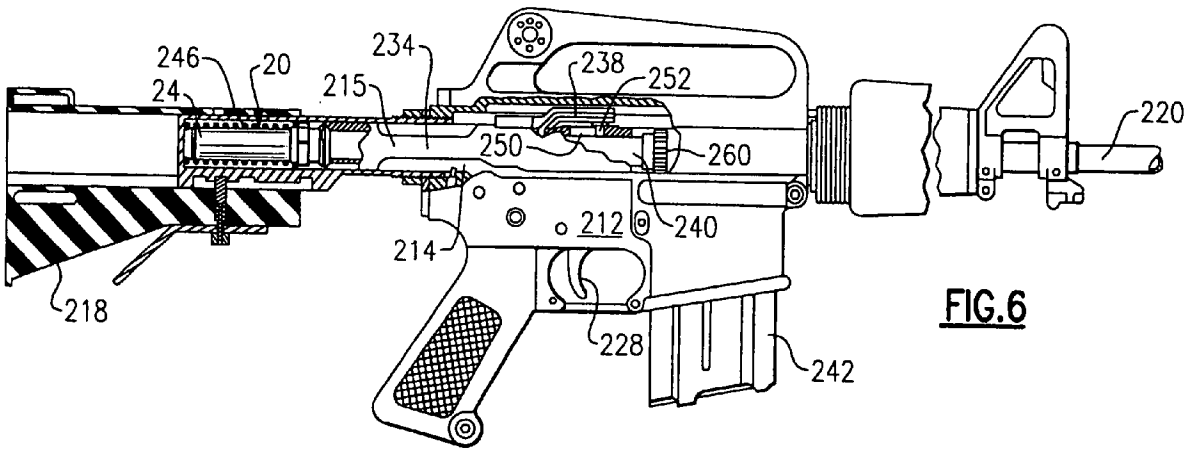
FIG. 6 is the side view of FIG. 5 depicting the hydraulic bolt buffer assembly in the recoil position.
Figure 7:
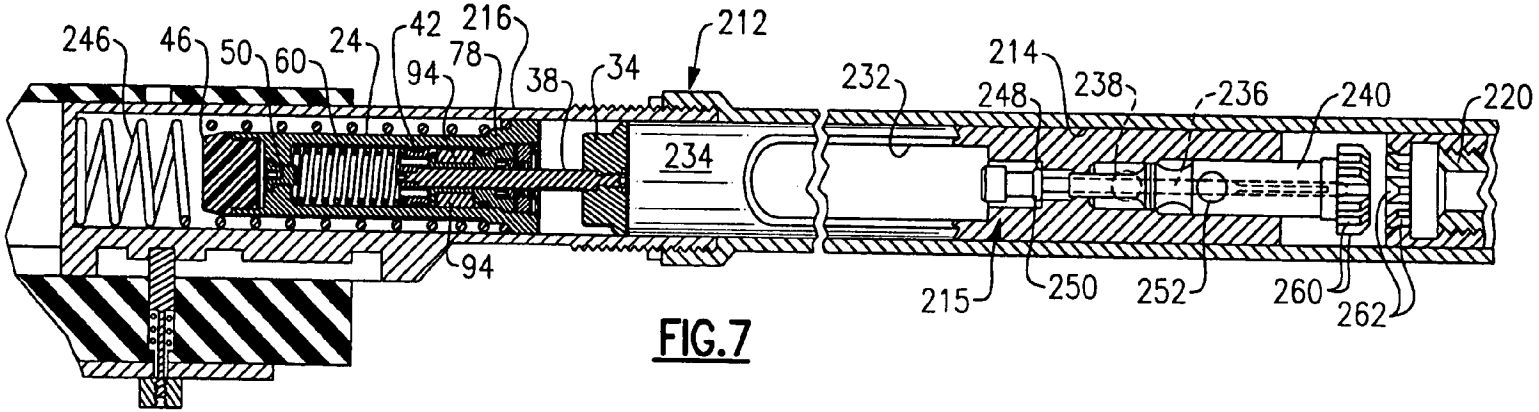
FIG. 7 is an enlarged partial view of the hydraulic bolt buffer assembly in the firearm of FIGS. 5 and 6.

Prior to describing the operational details of the buffer 20, additional discussion should first be made of the firing mechanism of an automatic firearm 200, shown in FIGS. 5–7. The firearm 200 shown herein includes a receiver 212 for receiving a bolt and carrier assembly 215. The rear portion of a chamber 214 is defined by a receiver extension 216 located in the stock 218. Connected to the forward location of the chamber 214 is a barrel 220 having a cartridge chamber 222 in which a cartridge 224 may be positioned.

A trigger mechanism 226 includes a trigger 228, that when pulled, releases a spring-biased hammer 230 through a slot 232 of a bolt carrier 234 and eventually strikes a firing pin 236 for firing the cartridge 224. The firing of the cartridge 224 causes the bullet to travel outwardly through the bore of the barrel of the firearm under the impetus of expanding gases. Some of these gases are diverted through a gas port (not shown) and ultimately reach a passage 238 in the bolt carrier 234, whereupon automatic recoil of the bolt carrier 234, and subsequently a bolt carried thereby, occurs. The automatic recoil of the bolt and carrier assembly 215 results in the ejection of the spent cartridge and subsequent chambering of a new cartridge 224 positioned in a magazine 242.

Automatic recoil using this firearm is provided as follows: A chamber 214, defined by a flange on the bolt 240 and the bolt carrier 234 fills with high pressure exhaust gas upon the firing of a cartridge 224, thereby driving the bolt carrier 234 rearwardly within the chamber 214 against the bias of an action or operating spring 246. This action initially causes an annular shoulder of the bolt carrier 234 to contact the flange 250 of the firing pin 236, while simultaneously, by virtue of the lost motion connection between the bolt carrier 234 and the bolt 240, causing a bolt cam pin 252 to travel in a helical slot 254 cut into the bolt carrier 234. Movement of the bolt cam pin 252 within the helical slot 254 produces rotation of the bolt 240 with respect to the nonrotating bolt carrier 234, the latter being held against rotation by the engagement of a carrier key 256 on the bolt carrier 234 and a longitudinal groove 258 in the receiver 212. Rotation of the bolt 240 results in the registration of lugs 260, the lugs being fashioned on the end of the bolt 240, and the slots between the inwardly extending lugs 262 on the breech end of the barrel 220, thereby permitting rearward movement of the entire bolt assembly 215 upon continuing recoil of the bolt carrier 234. The rearward momentum of the bolt and carrier assembly 215 is stored by the action spring 246 which, upon dissipation of the rearward momentum of the bolt carrier 234, forces the bolt and carrier assembly 215 to return to the battery position of FIG. 5. During the recoiling operation, the spent cartridge 224 is ejected and on the forward return stroke, a new cartridge 224 is stripped from the magazine 242 by the bolt 240 and thereafter chambered. During the latter part of the return stroke of the firearm 200, the bolt lugs 260 pass through the slots between the lugs 262, whereupon the bolt 240 is rotated in the locked battery position by the sliding contact between the walls of the slot 254 and the cam pin 252.

With the preceding background/description of the firearm 200, the buffer assembly 20 of the present invention moves within the receiver extension section of the firearm 200, wherein the bolt carrier assembly 215 is aligned with the piston cap 34 of the herein described buffer 20, though the latter is not fixedly attached thereto according to this embodiment. The buffer 20 is mounted for axial sliding movement in forward and rearward directions within the receiver extension in such a manner that is adapted to compress the action spring 246 during rearward movement and to be propelled by the action spring 246 during forward movement from the recoil position to the battery position. The piston cap 34 is aligned with the bolt and carrier assembly 215 such that the buffer is axially movable therewith and the exterior annular guide flange 27 serves as a seat for the coaxially positioned action spring 246, in addition to guiding the reciprocating movement of the buffer 20. The circumferential flats 29, 35 minimize air pressurization within the receiver extension during recoil and allow for the egress of water and other contaminants.

In terms of operation, the firearm 200 is initially in the battery position, FIG. 5, prior to firing. Upon firing of same, the entirety of the bolt and carrier assembly 215 and the aligned buffer 20 are each accelerated axially rearwardly from the depicted battery position in the manner previously described.

The bolt and carrier assembly 215 and the buffer 20 are each driven as a unit until the elastomeric bumper 46 of the buffer 20 contacts the back inner wall of the receiving extension 216 of the firearm 200 against the biasing force of the action or operating spring 246.

The piston assembly continues to be driven rearwardly against the bias of the contained buffer coil spring 60 moving toward the depressed position. This movement causes the piston head 42 to displace the volume of hydraulic fluid 110 from a first chamber 120 occupied by the spring 60 and defined between the distal side of the piston head 42 and the end wall 62 through the orifices 64 of the piston head into a second fluid chamber 128 defined between the proximal side of the piston head and the bearing 78, including the accumulator foam cavity of the bearing. As the fluid is forced through the orifices 64 into the accumulator foam cavity, the accumulator foam 94 is compressed due to the rod volume entering into the cylinder. The force created by the restricted fluid flowing through the orifices 64 decelerates the bolt and carrier assembly 215, thereby slowing the firing rate.

After completion of the recoil position of the cycle, shown in FIG. 3, the action spring 246 of the firearm 200 accelerates the buffer 20, as well as the aligned bolt and carrier assembly 215, proximally toward the battery position. While this movement occurs, the coil return spring 60 within the buffer 20 forces the piston head/rod assembly back to the fully extended position. During this movement, the hydraulic fluid 110 flows from the back of the piston head 42, through the orifices 64 to the front of the piston head thereby moving the fluid from the second fluid chamber 128 back into the first fluid chamber 120. As the hydraulic fluid 110 from the foam accumulator area flows through the piston head 42, the foam material 94 contained therein is decompressed.

Once the bolt carrier 234 hits the breech end of the barrel 220 of the firearm, the inertia of the buffer cylinder compresses the buffer 20 slightly and provides an extended resisting force against the bolt carrier 234, thus keeping the bolt carrier 234 and the bolt 240 from bouncing off the breech end of the barrel. The buffer assembly 20 then extends completely to the position shown in FIG. 4 (e.g., the battery position) and is ready for the next cycle.

Figure 8:
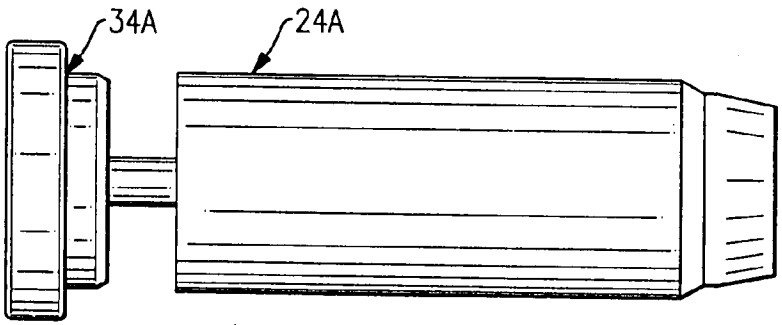
FIG. 8 is a side view of a buffer assembly in accordance with an alternative design.

According to an alternate design, shown in FIG. 8, the piston cap 34A of the hydraulic buffer assembly 20A can be configured to engage the action spring (not shown) of the firearm. In this instance, the cylinder of the housing 24A does not include a shoulder as in the preceding embodiment.

PARTS LIST FIGS. 1–8

20A hydraulic buffer assembly
20 hydraulic buffer assembly
24A housing
24 housing
27 exterior annular guide flange
29 flits
30 piston assembly
34A piston cap
34 piston cap
35 flats
38 piston rod
42 piston head
46 elastomeric bumper
50 fill plug
51 intermediate orifice
54 inner cavity
58 O-ring
60 coil spring
62 end wall
64 axial orifices
68 center opening
72 glide seal member
78 cylindrical bearing
82 center opening
86 O-ring
90 recess
94 foam material
98 wiper
100 U-cup seal
102 retainer, wiper
106 retainer plate
110 hydraulic fluid
120 first fluid chamber
128 second fluid chamber
200 firearm
212 receiver
214 chamber
215 bolt and carrier assembly
216 receiver extension
218 stock
222 cartridge chamber
224 cartridge
226 trigger mechanism
228 trigger
230 spring-biased hammer
232 slot
234 bolt carrier
236 firing pin
238 passage
240 bolt
242 magazine
246 operating or action spring
250 flange
252 bolt cam pin
254 helical slot
256 carrier key
258 longitudinal groove
260 lugs
262 lugs While the present invention has been described in terms of certain embodiments, it will be readily apparent that there are numerous modifications and variations that can be practiced by one of sufficient skill in the field which embody the inventive aspects described herein and as recited in the following claims:

We claim:

1. A hydraulic bolt buffer assembly for a firearm, said firearm including a receiver having a longitudinal chamber, a bolt and carrier assembly mounted in said chamber for reciprocating movement between a recoil position and a battery position, a spring for urging the buffer into contact with the bolt and carrier assembly for movement therewith and for biasing said bolt and carrier assembly toward the battery position, said buffer assembly comprising:

a housing having an inner cavity;

a piston disposed within the inner cavity of said housing and movable between an extended position and a depressed position, said piston being in contact with said bolt and carrier assembly;

a spring for biasing said piston in said extended position; and a stationary bearing member in fixed relation in said housing, said bearing member including means for providing a fluid-tight seal with said inner cavity and further retaining an accumulator in stationary relation along a primary axis of said buffer assembly wherein movement of said piston from the extended position to the depressed position causes hydraulic fluid contained in a first fluid chamber of said inner cavity to be moved to a second fluid chamber of said cavity containing said stationary accumulator and in which movement of said fluid into said second fluid chamber compresses said accumulator as said piston is moved to said depressed position.

2. A buffer assembly as recited in claim 1, wherein said piston includes a piston head including at least one orifice through which hydraulic fluid flows between said first fluid chamber and said second fluid chamber when said piston head is moved through said inner cavity of said housing.

3. A buffer assembly as recited in claim 1, including a bumper configured for contacting an end wall of a said firearm when said buffer assembly is axially moved to a recoil position therein.

4. A buffer assembly as recited in claim 3, wherein said bumper is attached within a cavity of said housing.

5. A buffer assembly as recited in claim 4, including a fill plug for filling said inner cavity with hydraulic fluid.

6. A buffer assembly as recited in claim 1, wherein the spring is moved to the depressed position when said buffer assembly and said bolt and carrier assembly are moved to the recoil position.

7. A buffer assembly as recited in claim 1, wherein the spring is moved to the extended position when said buffer and said bolt and carrier assembly are moved toward the battery position.

8. A buffer assembly as recited in claim 2, wherein said movable piston head includes at least one exterior seal member in engagement with the interior wall of said housing.

9. A buffer assembly as recited in claim 1, including a housing configured to support an action spring for urging said buffer into contact with said bolt and carrier assembly.

10. A buffer assembly as recited in claim 1, including a piston cap configured to support an action spring for urging said buffer assembly into contact with said bolt and carrier assembly.

11. A buffer assembly as recited in claim 1, including a piston cap for contacting the bolt and carrier assembly.

* * * * *

US007131367C1

(12) EX PARTE REEXAMINATION CERTIFICATE (10798th)

United States Patent
Boerschig et al.

(10) Number: US 7,131,367 C1
(45) Certificate Issued: Jan. 25, 2016

(54) HYDRAULIC BOLT BUFFER FOR FIREARM

(75) Inventors: Timothy J. Boerschig, Amherst, NY (US); Brian C. Bucholtz, Lakeview, NY (US)

(73) Assignee: ITT ENIDINE INC., Orchard Park, NY (US)

Reexamination Request:
No. 90/013,466, Mar. 11, 2015

Reexamination Certificate for:

| | |
|---|---|
| Patent No.: | **7,131,367** |
| Issued: | **Nov. 7, 2006** |
| Appl. No.: | **11/114,304** |
| Filed: | **Apr. 26, 2005** |

(51) Int. Cl.

| | |
|---|---|
| ***F41A 3/78*** | (2006.01) |
| ***F41A 3/94*** | (2006.01) |
| ***F41A 3/70*** | (2006.01) |

(52) U.S. Cl.
CPC .... *F41A 3/94* (2013.01); *F41A 3/70* (2013.01)

(58) Field of Classification Search
None
See application file for complete search history.

(56) References Cited

To view the complete listing of prior art documents cited during the proceeding for Reexamination Control Number 90/013,466, please refer to the USPTO's public Patent Application Information Retrieval (PAIR) system under the Display References tab.

*Primary Examiner* — Carlos Lopez

(57) ABSTRACT

A hydraulic bolt buffer assembly for an automatic firearm, the firearm including a receiver having a longitudinal chamber, a bolt and carrier assembly mounted in the chamber for reciprocating movement between a recoil position and a battery position, a spring for urging the buffer into contact with the bolt and carrier assembly for movement therewith and for biasing said bolt and carrier assembly toward the battery position. The buffer assembly includes a housing having an inner cavity, as well as a piston disposed within the inner cavity of the housing that is movable between an extended position and a depressed position, the piston being in contact with the bolt and carrier assembly. The buffer further includes a spring for biasing the piston in the extended position, as well as a bearing member in fixed relation in the housing and permitting a fluid tight seal with the interior of the buffer housing. The bearing further includes a cavity for retaining an accumulator disposed in a fluid chamber and in which movement of the piston based on movement of the bolt and carrier assembly causes hydraulic fluid contained in a first fluid chamber of said cavity to he moved to a second fluid chamber of said cavity containing the accumulator to slow the firing rate of the firearm.

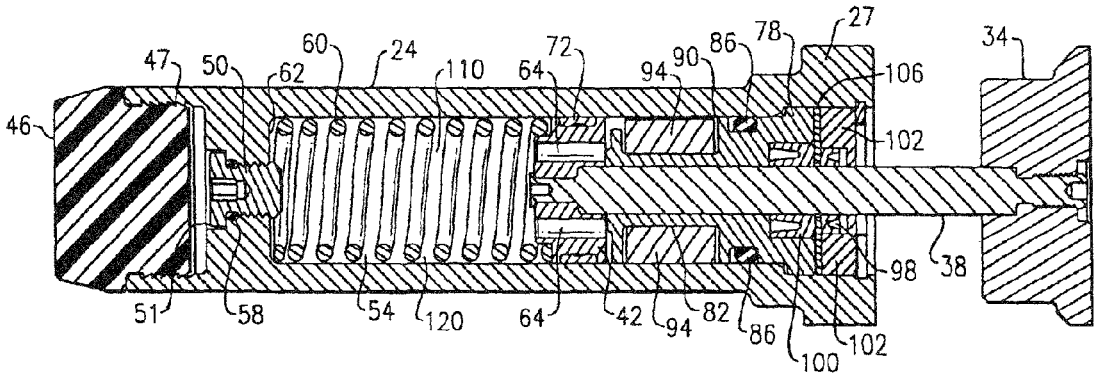

EX PARTE REEXAMINATION CERTIFICATE

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-11 is confirmed.

New claims 12-16 are added and determined to be patentable.

*12. A buffer assembly as recited in claim 10, wherein the piston cap includes a portion configured to support the action spring, said portion having a diameter that is larger than a diameter of the housing, and wherein the action spring surrounds the housing.*

*13. A buffer assembly as recited in claim 10, further comprising a piston rod and a wiper disposed adjacent the piston rod, the wiper being supported by a retainer.*

*14. A buffer assembly as recited in claim 13, wherein a retaining plate is disposed adjacent to the retainer.*

*15. A buffer assembly as recited in claim 14, further comprising a U-cup seal distally disposed relative to the wiper and the retaining plate, each of the retaining plate and retainer having center openings sized to permit the piston rod to extend therethrough.*

*16. A buffer assembly as recited in claim 10, wherein said piston includes a piston head, including at least one orifice and through which hydraulic fluid flows between said first fluid chamber and said second fluid chamber when said piston head is moved through said inner cavity of said housing and wherein said movable piston head includes at least one exterior seal member in engagement with the interior wall of said housing.*

* * * * *